US005620333A

United States Patent [19]

Boyle

[11] Patent Number: 5,620,333

[45] Date of Patent: Apr. 15, 1997

[54] ELECTRICAL CONNECTOR STRAIN RELIEF HOOD

[75] Inventor: Michael C. Boyle, Shelton, Conn.

[73] Assignee: Burndy Corporation, Norwalk, Conn.

[21] Appl. No.: 350,620

[22] Filed: Dec. 7, 1994

[51] Int. Cl.[6] ..... H01R 13/58

[52] U.S. Cl. ..... 439/471

[58] Field of Search ..... 439/470, 472, 439/471, 473, 345, 353, 357, 372, 352; 29/857, 858, 859, 860, 861, 862, 863

[56] References Cited

U.S. PATENT DOCUMENTS

| | | | |
|---|---|---|---|
| 3,701,071 | 10/1972 | Landman | 339/4 |
| 4,341,431 | 7/1982 | Woratyla | 439/471 |
| 4,370,013 | 1/1983 | Niitsu et al. | 439/352 |
| 4,449,776 | 5/1984 | Carmo et al. | 439/472 |
| 4,607,903 | 8/1986 | Hoshino et al. | 339/63 R |
| 4,714,433 | 12/1987 | Rider, Jr. | 439/310 |
| 4,871,325 | 10/1989 | Maejima et al. | 439/353 |
| 4,884,978 | 12/1989 | Inaba et al. | 439/352 |
| 4,941,839 | 7/1990 | Nagasaka et al. | 439/352 |
| 4,946,404 | 8/1990 | Takenouchi et al. | 439/352 |
| 5,403,199 | 4/1995 | Mobley et al. | 439/357 |

OTHER PUBLICATIONS

1. Souriau Catalog, Millipacs 1, pp. 50–51.

*Primary Examiner*—P. Austin Bradley
*Assistant Examiner*—Yong Kim
*Attorney, Agent, or Firm*—Perman & Green

[57] ABSTRACT

An electrical cable assembly having electrical wires, an electrical connector body, and a strain relief hood. The connector body is connected to first ends of the wires by electrical contacts. The strain relief hood is connected to the connector body and the cable. The hood has a first section snap-lock connected to the connector body and a second section attached to the cable. The first section includes a cantilevered side wall formed, at least partially, by two slots between the cantilevered side wall and two adjacent side walls. A latch for a second electrical connector is mounted over the cantilevered side wall for substantially preventing the cantilevered side wall from being outwardly deflected while the latch is connected to the hood.

21 Claims, 3 Drawing Sheets

ELECTRICAL CONNECTOR STRAIN RELIEF HOOD

BACKGROUND OF THE INVENTION

1. Field of the Invention

The present invention relates to electrical connectors and, more particularly, to a strain relief hood for an electrical connector.

2. Prior Art

Various different designs for connecting members together in the electrical connector arts are known to exist. Some of these designs can be found in U.S. Pat. Nos.: 3,701,071; 4,607,903; 4,714,433; 4,871,325; 4,884,978; 4,941,839; and 4,946,404. Souriau, a Framatome Connectors Internation Company, sells a round cable connector under the trademark MILLIPACS 1. The MILLIPACS 1 connector has a strain relief hood that is snap-lock mounted on a housing of a first connector and a connector latch for a second connector that is slidingly mounted to the strain relief hood.

SUMMARY OF THE INVENTION

In accordance with one embodiment of the present invention, an electrical cable assembly is provided comprising a plurality of electrical wires, an electrical connector body, and a strain relief hood. The connector body is connected to first ends of the electrical wires. The strain relief hood is connected to the connector body and the wires. The hood has a first section snap-lock connected to the connector body and a second section attached to the cable. The first section includes a cantilevered side wall formed, at least partially, by two slots between the side wall and two adjacent side walls.

In accordance with another embodiment of the present invention, a strain relief for an electrical cable and an electrical connector is provided comprising a main body, a latch, and a fastener. The main body has a first end with a snap-lock section adapted to snap-lock connect to the electrical connector, a second end with a cable support surface, and a cable channel between the first and second ends. The latch is adapted to mount to the main body over the snap-lock section. The latch substantially prevents the snap-lock section from being outwardly reflected. The fastener is adapted to mount to the second end of the main body for holding the cable against the cable support surface.

In accordance with one method of the present invention, a method of assembling an electrical cable assembly is provided comprising steps of connecting an electrical connector to wires of an electrical cable; snap-lock mounting a snap-lock section of a strain relief main body to the connector; and attaching a latch to the main body over the snap-lock section to prevent the snap-lock section from being substantially moved relative to the rest of the main body while the latch is attached to the main body.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
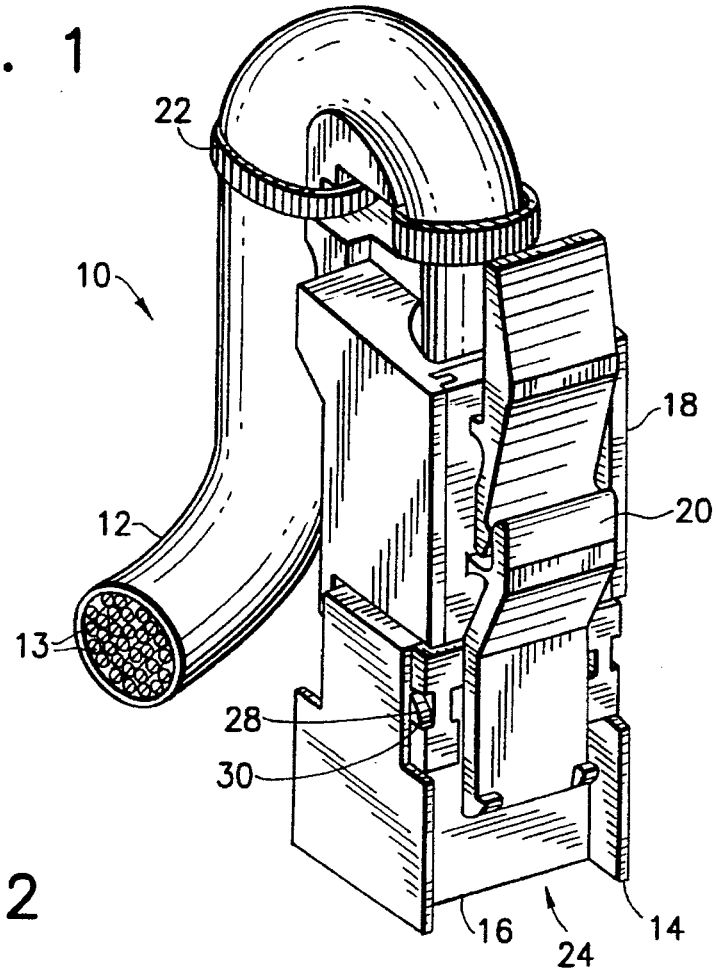
FIG. 1 is a perspective view of an end of an electrical cable assembly incorporating features of the present invention.

Referring to FIG. 1, there is shown a perspective view of an end of an electrical cable assembly 10 incorporating features of the present invention. Although the present invention will be described with reference to the single embodiment shown in the drawings, it should be understood that the present invention could be embodied in many different types of alternative embodiments. In addition, any suitable size, shape or type of elements or materials could be used.

The cable assembly 10 generally comprises an electrical cable 12 having electrical wires 13, and a connector assembly 14. The connector assembly 14 includes a connector body 16, electrical contacts (not shown), a strain relief hood 18, a second connector latch 20, and a cable fastener 22. The connector body 16 is preferably made of a dielectric plastic or polymer material and has a front end 24 adapted for connection to a second mating electrical connector (not shown). The electrical contacts (not shown) of the connector assembly 14 are fixedly mounted in the connector body 16. First ends of the wires 13 are connected to the contacts. The wires 13 extend out of the rear end 26 of the connector body 16 into the hood 18. Located on two opposite sides of the connector body 16 are projections 28 for connecting the connector body 16 to the hood 18. The projections 28 have a wedge-like shape with a latching surface 30 facing the front of the connector body 16.

Figure 2:
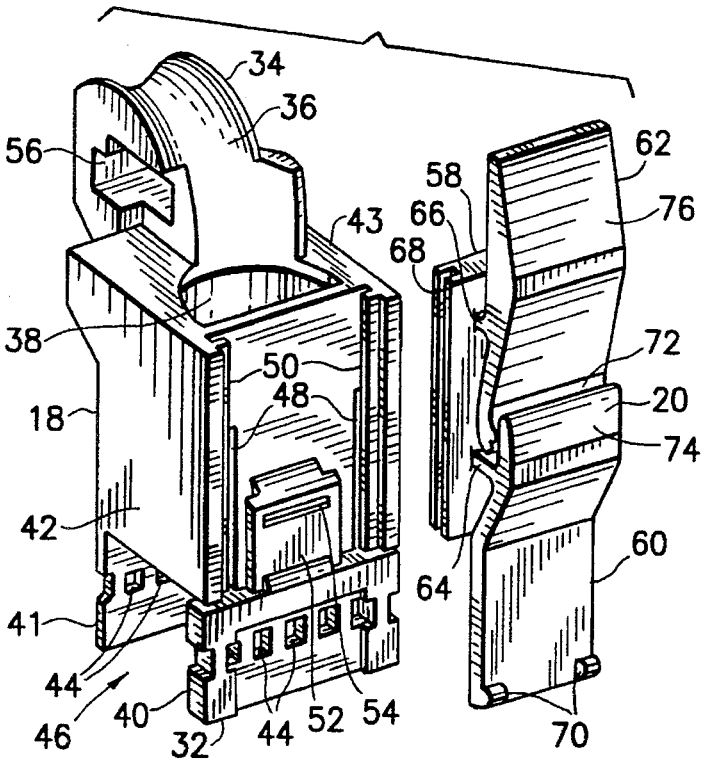
FIG. 2 is an exploded perspective view of the strain relief hood and latch of the assembly shown in FIG. 1.

Referring also to FIG. 2, the hood 18 and latch 20 are preferably comprised of a dielectric resilient plastic or polymer material. The hood 18 forms a main body for the strain relief of the wires 13. The hood 18 has a first end 32 with a snap-lock section, a second end 34 with a cable support surface 36, and a channel 38 between the two ends 32, 34. The snap-lock section includes two opposite sides 40, 41 of the hood 18 that extend past the adjacent sides 42, 43. Both extended sides 40, 41 have holes 44 adapted to receive the projections 28 of the connector body 16. A receiving area 46 is formed between the two extended sides 40, 41 for receiving the rear portion of the connector body 16. The first extended side 40 also includes two slots 48 that extend into the channel 38. The slots 48 are located proximate the side walls 42, 43 and extend about two-thirds the length of the walls 42, 43. In this fashion, the wall 40 has a general cantilever configuration. The walls 42, 43 have inwardly facing rails 50 located past a portion of the cantilevered wall 40. The cantilevered wall 40 also has an exterior projecting lug 52 and a locking projection 54. The second end 34 has a hole 56 for passing the fastener 22 through. The fastener 22, in this embodiment, is merely a strap to hold the cable 12 against the surface 36.

The latch 20 has a base section 58, and two lever sections 60 and 62. The lever sections 60, 62 are formed integral with the base section 58 on pedestal pivot sections 64, 66. The base section 58 has two tracks 68 on opposite sides adapted to slidingly ride between the two rails 50 of the hood 18. The back end of the base section 58 also has a recess (not shown) for mating with the projecting lug 52 and locking with the locking projection 54. The first lever section 60 has latching projections 70 for making a latching engagement with a mating electrical connector (not shown). The second lever section 62 has a first end 72 located under an end 74 of the first lever section 60, and a second end 76 adapted to be depressed by a user's finger. When the second end 76 is depressed by a user, the latching projections 70 are retracted towards the connector body 16 to unlatch the two connectors from each other.

Figure 3:
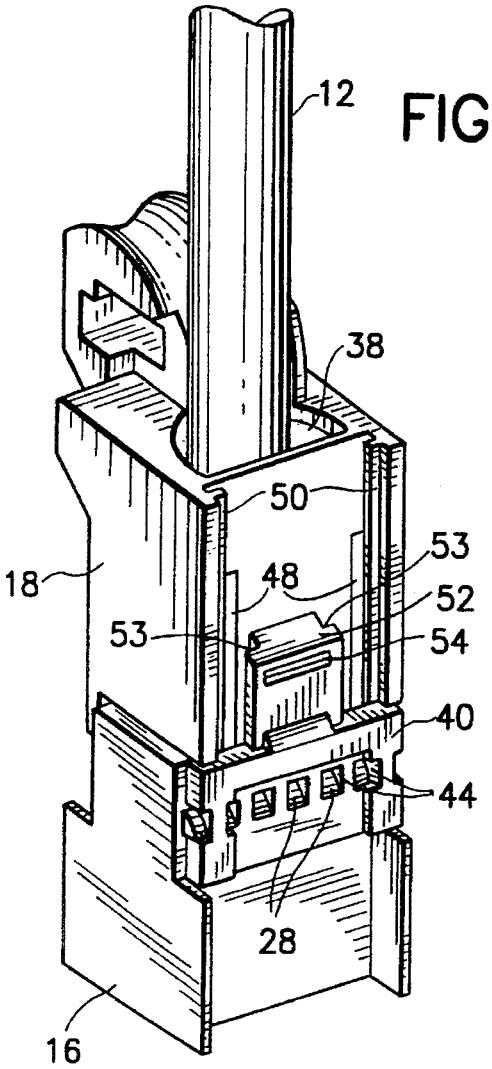
FIG. 3 is a perspective view of the connector, hood, and cable of the assembly shown in FIG. 1 shown at a partially assembled state.
Figure 4:
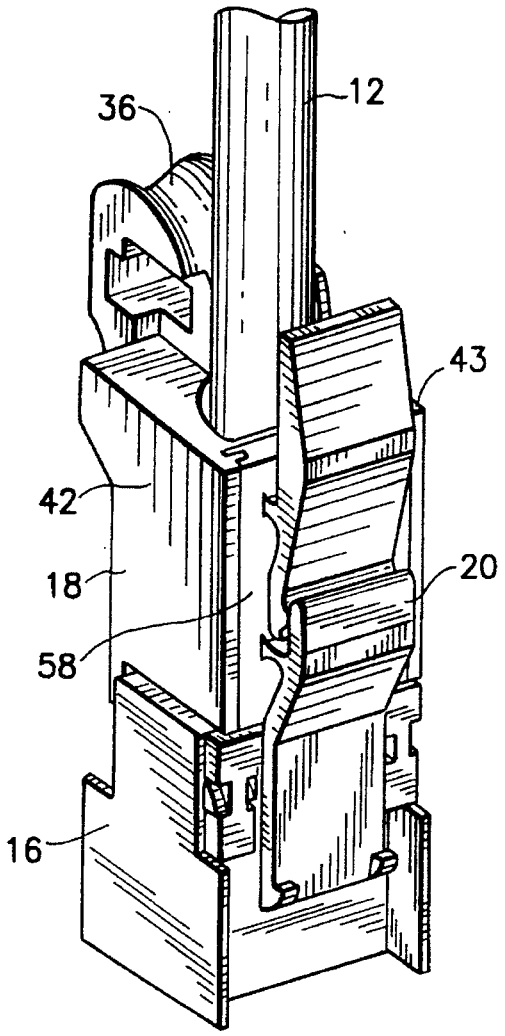
FIG. 4 is a perspective view of the components as shown in FIG. 3 with the latch of the assembly connected to the strain relief hood.

Referring now also to FIG. 3, assembly of the cable assembly 10 will be described. The electrical contacts (not shown) are first connected to the individual wires 13 of the cable 12 and inserted into the connector body 16. Then the hood 18 is snap-lock connected to the connector body 16 with the cable 12 passing through channel 38. During the snap-lock connecting procedure, the cantilevered side wall 40 is outwardly deflected until the holes 44 on the two sides 40, 41 come into registry with the projections 28 on the connector body 16. When this happens, the cantilevered side wall 40 snaps back to its original position with the projections 28 being located in the holes 44. This effectively locks the connector body 16 to the hood 18. Referring also to FIG. 4, the latch 20 is then mounted on the hood 18. The latch 20 is slid on and between the rails 50 of the hood 18 and makes a mating and interlocking engagement with the lug 52 and locking projection 54. A portion of the base section 58 is interlocked behind the lug 52 in areas 53. With the latch 20 securely in place, the base section 58 substantially prevents the outward deflection of the cantilevered wall 40, at least at the area between the two adjacent walls 42, 43. This effectively eliminates the cantilever function of the slots 48. Thus, although the cantilevered wall 40 allows the hood 18 to be relatively easily outwardly deflected for connection to the connector body 16, after the latch 20 is attached to the hood 18 the wall 40 is very hard to outwardly deflect. Therefore, disconnection of the hood 18 from the connector body 16 is extremely difficult. The relatively long cantilever length of the cantilevered wall 40 helps to assure that the wall 40 will not be permanently deformed during snap-locking to the connector body 16. In addition, if necessary, the latch 20 can be removed from the hood 18 and the hood 18 then removed from the connector body 16 to repair the connection of the wires 13 to the contacts or the contacts themselves. After the latch 20 is mounted to the hood 18, the cable 12 is then positioned against the cable support surface 36 and the fastener 22 is attached.

In alternate embodiments other types of connector bodies, hoods, latches and/or fasteners could be adapted to incorporate the present invention. Other types of interlocks between the connector body and the hood, and/or the hood and the latch could be provided. Rather than a latch, the assembly could include any suitable type of member to be positioned on the cantilevered wall and its adjacent walls. The cable support surface could also have any suitable direction or shape.

Figure 5:
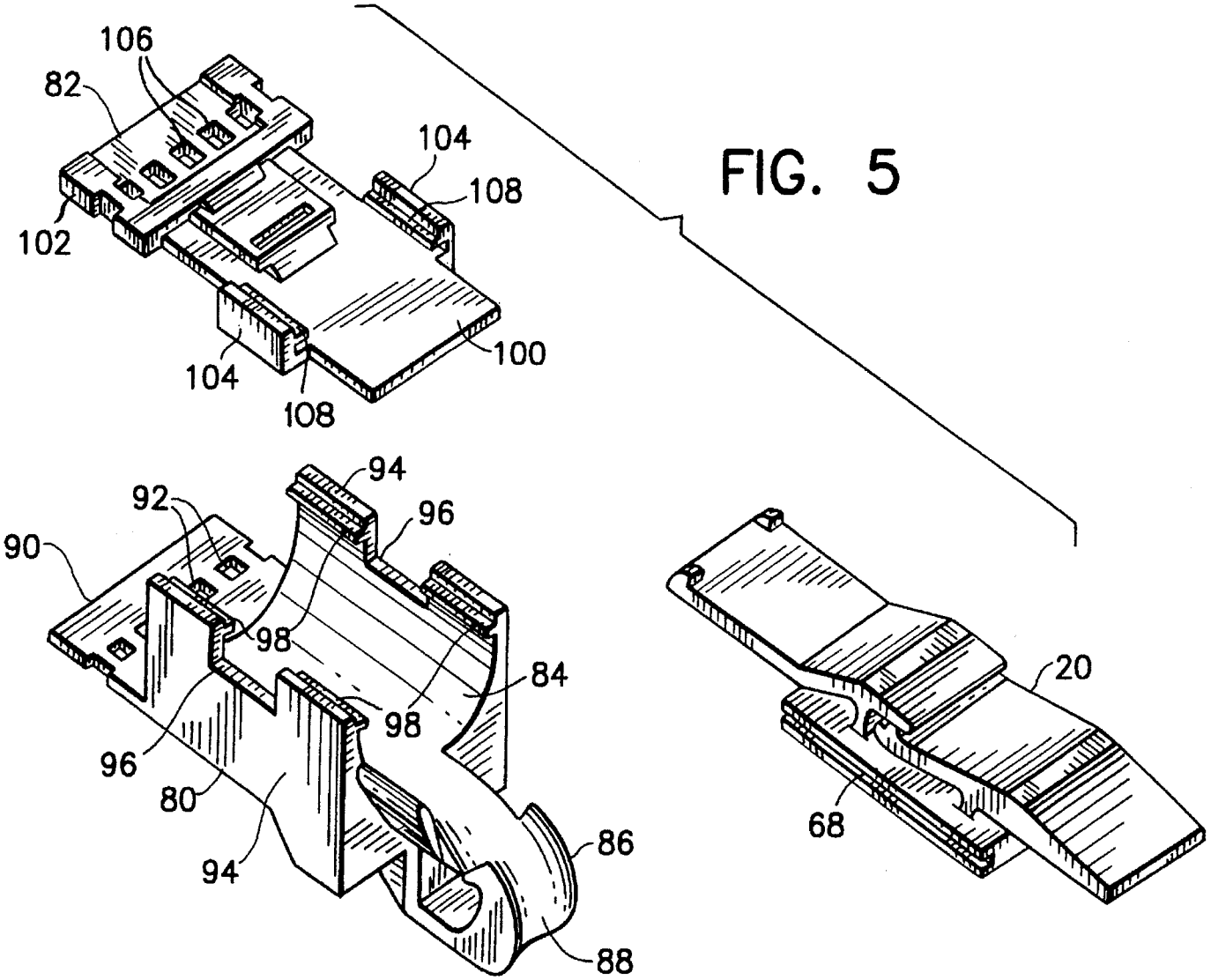
FIG. 5 is an exploded perspective view of components of an alternate embodiment of the present invention.

Referring now to FIG. 5, there is shown an exploded perspective view of components of an alternate embodiment of the invention. In this embodiment the main body of the strain relief hood is comprised of a first member 80 and a second member 82. The latch 20 is the same latch seen in FIGS. 1, 2 and 4. The first member 80 has a channel 84 with a substantially open side area. The channel 84 is to locate a cable in. The first member 80 has an end 86 with a cable support surface 88 and an opposite end 90 with holes 92 adapted to receive projections 28 of the connector body 16 (see FIG. 3). The lateral sides 94 of the first member 80, adjacent the substantially open side, each have a notch 96 and latch mounting rails 98. The mounting rails face each other across the substantially open side. The second member 82 has a center section 100, an end 102, and two lateral projections 104. The center section 100 is suitably sized and shaped to be located in the substantially open side of the first member 80 to substantially close that side. The end 102 has holes 106 adapted to receive projections 28 of the connector body 16 (see FIG. 3). The two lateral projections 104 are suitably sized and shaped to fit in the two notches 96 of the first member 80. The projections 104 each extend above the center section 100 and have rails 108 that are aligned with the rails 98 when the second member 82 is mounted on the first member 80. Because the notches 96 are open, the second member 82 could become dismounted unless positively retained. Retainment is accomplished by means of the latch 20. More specifically, when the latch 20 is attached to the rails 98, the latch 20 prevents the second member 82 from moving; both by having the rails 108 in the tracks 68 and, being located over the center section 100. In other alternate embodiments, other types of means to interlock and fix the two main body members to each other could be provided. This type of embodiment has the advantage of adding flexibility to the assembly process. In addition, cable and connector assemblies can be repaired by easily removing the strain relief hood. Connection of the connector latch to the hood main body could also take other forms and, the latch need not directly connect to the second member at the lateral projections.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical cable assembly comprising:

a cable having a plurality of electrical wires;

an electrical connector body connected to the cable by first ends of the electrical wires; and a strain relief hood connected to the connector body and the cable, the hood having a first section snap-lock connected to the connector body and a second section attached to the cable, the first section including an outwardly deflectable cantilevered side wall formed, at least partially, by two slots between the cantilevered side wall and two other side walls adjacent to the cantilevered side wall wherein the strain relief hood includes a first member and an interlocked second member.

2. An assembly as in claim 1 further comprising a latch connected to the hood over the cantilevered side wall for substantially preventing the cantilevered side wall from being outwardly deflected.

3. An assembly as in claim 2 wherein the latch is slid over the cantilevered side wall on rails extending from the adjacent side walls.

4. An assembly as in claim 3 wherein the hood has a projection locking the latch in place on the hood.

5. An assembly as in claim 1 wherein the cantilevered side wall and an opposite side wall have holes for receiving projections on the electrical connector body.

6. An assembly as in claim 1 wherein the slots extend about two-thirds the length of the side walls adjacent the cantilevered side wall.

7. An assembly as in claim 1 wherein the first member has rails extending towards each other from opposite sides and further comprising a latch mounted on the rails to fixedly retain the second member in its interlocked position with the first member.

8. An assembly as in claim 7 wherein the second member has rails that are aligned with the rails of the first member.

9. A strain relief for an electrical cable and an electrical connector, the strain relief comprising:

a main body having a first end with a snap-lock section adapted to snap-lock connect to the electrical connector, a second end with a cable support surface, and a cable channel between the first and second ends;

a latch adapted to mount to the main body over the snap-lock section, the latch substantially preventing the snap-lock section from being outwardly deflected; and a fastener adapted to mount to the second end of the main body for holding the cable against the cable support surface, wherein the snap-lock section includes a cantilevered side wall formed, at least partially, by two slots along the cantilevered side wall and two adjacent side walls.

10. A strain relief as in claim 9 wherein the slots extend about two-thirds the length of the side walls adjacent the cantilevered side wall.

11. A strain relief as in claim 9 wherein the main body has rails extending from the two side walls adjacent the cantilevered side wall that the latch is slidingly mounted on.

12. A strain relief as in claim 9 wherein the cantilevered side wall extends past ends of the two adjacent side walls and has holes for receiving projections on the electrical connector.

13. A strain relief as in claim 9 wherein the main body has means for locking the latch on the main body.

14. A strain relief as in claim 9 wherein the main body has a first member and an interlocked second member.

15. A strain relief as in claim 14 wherein the first member has notches in sides adjacent a substantially open side and the second member has portions that are located in the notches with the second member substantially closing the open side.

16. A strain relief as in claim 14 wherein the snap-lock section is located on the second member.

17. A strain relief as in claim 16 wherein the sides of the first member adjacent the substantially open side have guide rails which the latch is mounted on to hold the first and second members together.

18. A method of assembling an electrical cable assembly comprising steps of:

connecting an electrical connector to wires of an electrical cable;

snap-lock mounting a snap-lock section of a strain relief main body to the connector; and attaching a latch to the main body over the snap-lock section to prevent the snap-lock section from being substantially moved relative to the rest of the main body while the latch is attached to the main body, wherein the step of attaching the latch comprises sliding the latch along side rails of the main body over a cantilevered side wall of the main body to thereby substantially prevent the cantilevered side wall from being outwardly deflected.

19. A method as in claim 18 further comprising connecting the cable to a portion of the main body by means of a fastener.

20. A strain relief for an electrical cable and an electrical connector, the strain relief comprising:

a first member having a channel with lateral sides adjacent a substantially open side, the lateral sides each having a notch and latch mounting rails;

a second member mounted on the first member at the substantially open side with lateral projections located in the notches; and a latch for connecting the strain relief to an electrical connector, the latch being connected to the first member over the second member on the latch mounting rails to retain the second member with the first member.

21. An electrical cable assembly comprising:

a cable having a plurality of electrical wires;

an electrical connector body connected to the cable at first ends of the electrical wires; and a strain relief hood connected to the connector body and the cable, the hood having a first section snap-lock connected to the connector body and a second section attached to the cable, the first section including an outwardly deflectable cantilevered side wall formed, at least partially, by two slots between the cantilevered side wall and two other side walls adjacent to the cantilevered side wall, wherein the cantilevered side wall and an opposite side wall have holes for receiving projections on the electrical connector body.

* * * * *